US005307765A

United States Patent [19]

Virr

[11] Patent Number: 5,307,765

[45] Date of Patent: * May 3, 1994

[54] ROTARY FLUID BED USED TO GASIFY AND COMBUST OIL-IN WATER EMULSIONS

[76] Inventor: Michael J. Virr, 1222 Bronson Rd., Fairfield, Conn. 06430

[ * ] Notice: The portion of the term of this patent subsequent to Dec. 10, 2008 has been disclaimed.

[21] Appl. No.: 987,763

[22] Filed: Dec. 9, 1992

[51] Int. Cl.[5] ..... F22D 1/00

[52] U.S. Cl. ..... 122/4 D; 110/226; 110/246; 431/168; 431/170; 431/7; 431/10; 431/352; 431/353

[58] Field of Search ..... 431/168, 170, 7, 8, 431/10, 2, 159, 261, 247, 330, 352, 353; 122/11, 4 D; 110/226, 246, 261, 229

[56] References Cited

U.S. PATENT DOCUMENTS 4,039,272 8/1977 Elliot ..... 431/7
4,177,636 12/1979 Horgan ..... 60/39.35
4,368,032 1/1983 Araya et al. ..... 431/118
5,002,483 3/1991 Becker ..... 431/352
5,070,821 12/1991 Virr ..... 122/7 K

*Primary Examiner*—Henry A. Bennet
*Assistant Examiner*—William C. Doerrler
*Attorney, Agent, or Firm*—Ohlandt, Greeley & Ruggiero

[57] ABSTRACT

A rotary fluid bed gasifier which comprises: a rotatable drum having a circumferentially extending wall which is permeable to gases; a means for feeding a fluidizing gas through the wall into the drum; a bed of particles which, at least when the gasifier is in use, is supported on an internal face of the wall and is fluidized by the fluidizing gas; an outlet means for receiving an oil-in-water emulsion from outside the gasifier and delivering the oil-in-water emulsion to the drum; a means for introducing steam into the drum; a de-$NO_x$ boiler having a quench zone and a nitrogen fixing zone; a means for introducing secondary air disposed between the quench zone and the nitrogen fixing zone; and a means for introducing tertiary air disposed between the de-$NO_x$ boiler and a main boiler or furnace.

14 Claims, 4 Drawing Sheets

ROTARY FLUID BED USED TO GASIFY AND COMBUST OIL-IN WATER EMULSIONS

The present invention relates to a novel rotary fluid bed gasifier which is affixed to the boiler of a power station wherein oil-in-water emulsion is gasified and combusted efficiently to produce steam or to a heat treatment furnace with reduced $SO_x$ and $NO_x$ emissions.

BACKGROUND OF THE INVENTION

Due to the high cost of oil and the inherent dangers associated with nuclear energy, engineers and scientists are again turning to alternate sources of energy such as coal and oil-in-water emulsions. Coal is typically burned to generate heat which is captured as steam in packaged boilers. It is also possible to burn oil-in-water emulsions in such packaged boilers. The steam is either used to power a turbine which turns a generator and produces electricity or used in industrial process applications. Unfortunately, the burning of coal and oil-in-water emulsions produce $SO_x$ and $NO_x$ which is extremely hazardous to the environment.

Oil-in-water emulsion is a new liquid fuel for the power and industrial energy sectors. It can be used, with minor modifications in any of the many presently under utilized oil or coal fired plants worldwide. The excellent combustibility of oil-in-water emulsion and the high turn down capability of burners firing such emulsions suggest that co-firing these emulsions with coal would increase the ability of boilers to follow complex load patterns. As such, oil-in-water emulsions create the opportunity to produce electricity competitive with electricity produced with coal, without having to build new coal plants.

Oil-in-water emulsions, such as bitumen-in-water, have the following characteristics:

| | |
|---|---|
| water content | 30% |
| median droplet size | 20 μm |
| density | 1,010 $Kgm^{-3}$ |
| vandium | 300 ppm |
| sodium | 70 ppm |
| magnesium | 350 ppm |
| carbon | 60.0% |
| hydrogen | 7.5% |
| sulfur | 2.7% |
| nitrogen | 0.50% |
| oxygen | 0.20% |
| ash | 0.25% |

Conventional package boilers are typically equipped with pulverized coal dispersion burners. Referring to FIG. 3 attached hereto, burners 1, 2, and 3 receive coal from coal bunker 4 and classifier 5. The coal is first pulverized into fine particles by a crusher or mill 6 which is powered by motor 18. The fine coal particles are delivered to the burners (1,2,3) by means of conduit 7 which includes coal fan 8 and coal valve 9. Combustion air is delivered to the burners (1,2,3) via forced draft fan or blower 10. The fine coal particles are propelled from the burners (1,2,3) into combustion chamber 11, wherein the coal is burned and the heat generated therefrom is used to produce steam. Substantial heat transfer occurs at platen 12 and superheater 13. Thereafter, the flue gases pass through economizer 14, wet scrubber 15 and stack 16. The flue gases which exit wet scrubber 15 are directed to stack 16 via induced draft fan or blower 17. The burners used in conventional pulverized coal boilers are inefficient insofar as they use a lot of power, require expensive coal pulverization, necessitate the application of expensive wet scrubbers to reduce $SO_x$ emissions, and produce flue gases with undesirably high $NO_x$ levels. Furthermore, $NO_x$ levels are typically reduced via selective catalytic reduction by injecting ammonium or urea, but ammonia may occur and the additive solutions are expensive.

The present inventor has attempted to modify package boilers to use oil-in-water emulsion in place of coal as its feed fuel. Unfortunately, these emulsions have extremely high contents of $SO_x$ and $NO_x$ which is unexceptable from an environmental standpoint.

In an effort to overcome the above-mentioned disadvantages of conventional burners and to provide a more environmentally acceptable means for producing energy from oil-in-water emulsion, the present inventor has investigated the use of rotating fluid bed combustors as burners in oil or coal fired boiler applications.

Early research on rotating fluid bed combustors is set forth in U.S. Pat. No. 4,039,272 (Elliott), which issued Aug. 2, 1977, and articles by C.I. Metcalfe and J.R. Howard, "Fluidization and Gas Combustion in a Rotating Fluidised Bed," *Applied Energy*, Applied Science Publishers Ltd., Vol. 3, (1977), pp. 65–73, and J. Broughton and D.E. Elliott, "Heat Transfer and Combustion in Centrifugal Fluidized Beds," *I. Chem. E. Symposium Series No. 43*, pp. 11–1 to 11–6.

All of the aforementioned rotary fluidized bed combustors were directed to combustion of coal in drums which rotated about their vertical axis so as to form substantially vertical beds. U.S. Pat. No. 4,039,272 (Elliott) discloses an apparatus for carrying out a reaction in a fluidized bed comprising a rotatable drum with a circumferential wall which is permeable to gases. A bed of particles is supported on the circumferential wall of the rotating drum during operation and the reactants are fed into the bed. A fluidizing gas is passed through the circumferential wall of the drum. A receiver is provided to retain small particles carried from the bed by the fluidizing gas. The small particles are returned to the bed when operation ceases. A reservoir for discharging larger particles into the bed after operation has commenced may be provided.

When the drum is rotated, the particles of which the bed is composed tend to move away from the axis of rotation towards the circumferential wall. If the fluidizing gases are admitted to the bed through the circumferential wall, the centrifugal action opposes the action of the gases on the particles and, provided the drum is rotated at a sufficiently high speed, the particles will not be blown completely away from the circumferential wall by fluidizing gases entering the bed at high speed. Variable speed drive means may be provided for rotating the drum. This arrangement enables the apparatus to operate satisfactorily with widely different rates of supply of combustible material and oxidant.

The apparatus according to the Elliott patent may also be used for gasification of coal, in which case air would be fed into the drum at a rate lower than that necessary to provide for complete combustion of the fuel. Gases leaving the drum through the outlet would then contain combustible gases.

The Metcalfe et al. article proposed that fuel flow rates in conventional fluidized bed combustors are limited by the maximum fluidization velocity at which the bed can operate without particles being elutriated from the bed; whereas a rotating fluidized bed combustor would allow the operating range to be extended by imposing a high centripetal acceleration on the particles which allows the bed to operate with higher fluidization velocities.

The Broughton article proposed that combustion intensity can be accomplished by means of rotating a cylindrical bed about its axis thus providing a centrifugal field which allows the fluidizing velocity for a given particle size to be increased more or less in proportion to the number of gravities imposed.

The aforementioned references disclose only vertically disposed rotary fluid bed combustors. The present inventor has developed a novel rotary fluid bed gasifier for use as novel burners attached to a boiler or furnace. This burner is extremely efficient and produces far less environmentally hazardous emissions then conventional burners.

Additional advantages of the present invention shall become apparent as described below.

SUMMARY OF THE INVENTION

A rotary fluid bed gasifier which comprises: a rotatable drum having a circumferentially extending wall which is permeable to gases; a means for feeding a fluidizing gas through the wall into the drum; a bed of particles which, at least when the gasifier is in use, is supported on an internal face of the wall and is fluidized by the fluidizing gas; an outlet means for receiving an oil-in-water emulsion from outside the gasifier and delivering the oil-in-water emulsion to the drum; a de-$NO_x$ boiler having a quench zone and a nitrogen fixing zone; a means for introducing secondary air disposed between the quench zone and the nitrogen fixing zone; and a means for introducing tertiary air disposed between the de-$NO_x$ boiler and a main boiler or furnace.

An additional object of the present invention is a system for producing steam from the combustion of a carbonaceous material which comprises: a rotary fluid bed gasifier; a boiler; a superheater; an economizer; a baghouse; and a stack.

A further object of the present invention is a method of producing steam from the combustion of a carbonaceous material in a rotary fluid bed gasifier comprising the steps of: introducing a fluidizing gas and a combustible gas into the drum wherein bed particles are fluidized; igniting the combustible gas within a drum of the rotary fluid bed gasifier; heating the bed particles to approximately 1000° F.; introducing an oil-in-water emulsion to the drum; removing the combustible gas; controlling the temperature within the drum to between about 1600°-1800° F. by adjusting the flow rate of the fluidizing gas, the speed of the drum, and the rate of introduction of the oil-in-water emulsion; and introducing the secondary air and tertiary air into a de-$NO_x$ boiler of the rotary fluid bed gasifier. The fluidizing gas is preferably fed into the drum at a rate lower than that necessary to provide for complete combustion of the oil-in-water emulsion so as to produce a low Btu gas.

A further object of the present invention is a method for gasifying a carbonaceous material using the rotary fluid bed gasifier according to the present invention.

Other and further objects, advantages and features of the present invention will be understood by reference to the following specification in conjunction with the annexed drawings, wherein like parts have been given like numbers.

DESCRIPTION OF THE PREFERRED EMBODIMENTS

The rotary fluid bed gasifier is a shallow fluid bed which is supported on the circumference of a rotary drum which holds the bed in position. This results in the ability to achieve high 'g' forces in the bed which in turn makes possible the use of higher velocities than are possible with 1 'g' beds. In this manner a gasifier may be operated at velocities up to 20 ft/sec. at combustion intensities of $3.2\times10^6$ Btu/ft$^3$/hr at atmospheric pressure. However, the rotary fluid bed gasifier of the present invention is operated at about one quarter to one half of this as it is only required to product low Btu gas. The gasifier is fueled with a carbonaceous material, such as light gas oil, gas or coal.

Figure 1:
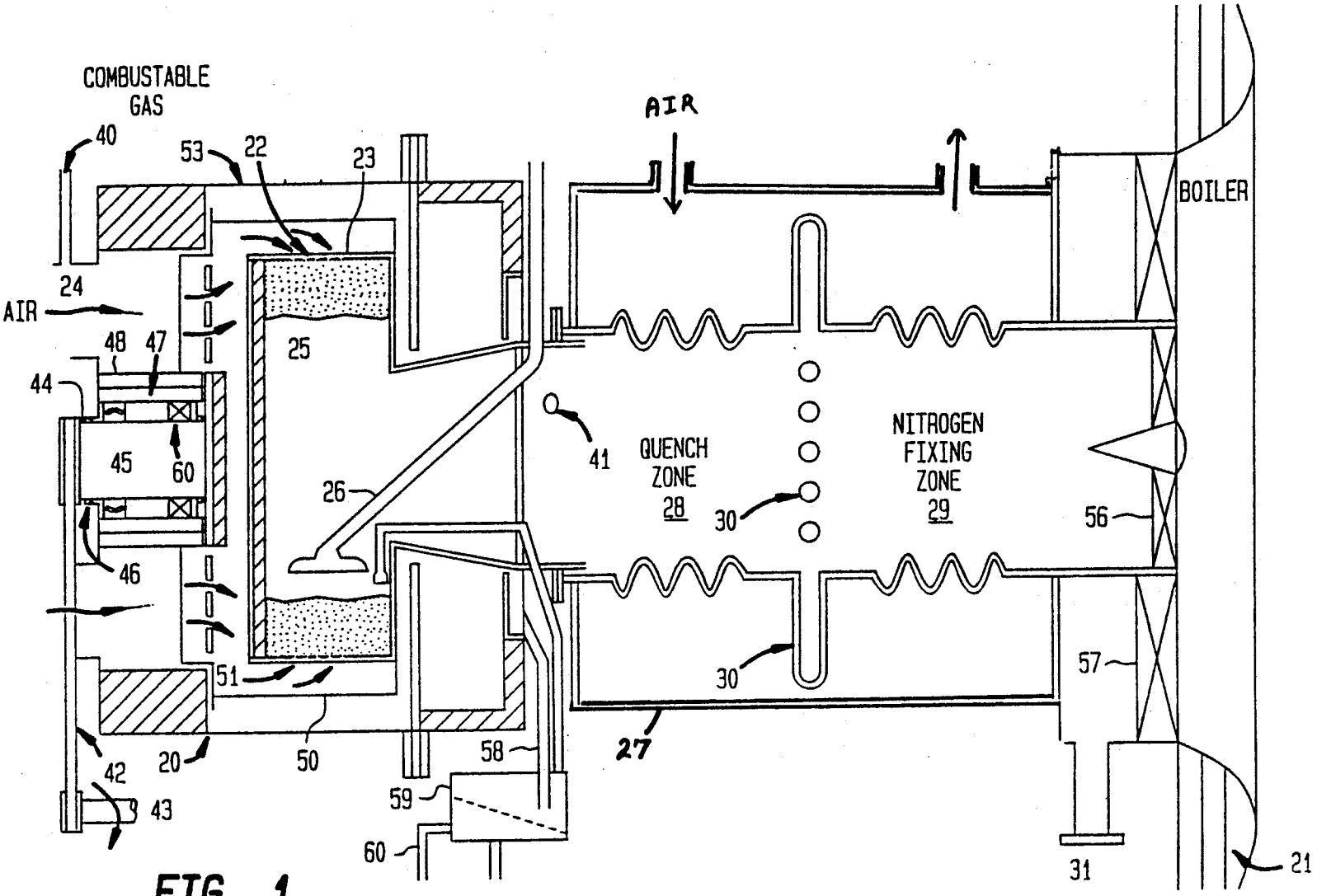
FIG. 1 is a schematic representation of a rotary fluid bed gasifier in accordance with the present invention.

The present invention can best be described by referring to the attached drawings, wherein FIG. 1 is a schematic representation of the novel rotary fluid bed gasifier. The rotary fluid bed gasifier 20 is bolted to a wall of boiler 21. Rotary fluid bed gasifier 20 comprises: a rotatable drum 22 having a circumferentially extending wall 23 which is permeable to gases; feed means 24 for feeding a fluidizing gas, e.g., air or a combination of air and a combustible gas, through wall 23 into drum 22; a bed of particles 25 which, at least when gasifier 20 is in use, is supported on an internal face of wall 23 and is fluidized by the fluidizing gas; an outlet means 26 for receiving an oil-in-water emulsion from outside gasifier 20 and delivering the oil-in-water emulsion to drum 22; a de-$NO_x$ boiler 27 having a quench zone 28 and a nitrogen fixing zone 29; a means 30 for introducing secondary air disposed between quench zone 28 and nitrogen fixing zone 29; and a means 31 for introducing tertiary air disposed between de-$NO_x$ boiler 27 and main boiler or furnace 21.

The water content of the emulsion and the fluidizing gas comprising approximately 10-80% stoichiometric air produces a reducing condition in drum 22. Outlet means 26 may simultaneously be used for receiving limestone, in addition to oil-in-water emulsion, from outside gasifier 20 and delivering the limestone to drum 22.

Gasifier 20 is positioned horizontally such that drum 22 rotates about its horizontal axis causing a horizontally sloping particle bed 25 within drum 22.

The present invention also includes a method of producing steam from the combustion of an oil-in-water in rotary fluid bed gasifier 20 comprising the steps of: introducing a fluidizing gas and a combustible gas via conduits 24 and 40, respectively, into drum 22 wherein bed particles 25, e.g., sand, are fluidized; igniting the combustible gas within drum 22 by light-up burner 41; heating bed particles 25 to approximately 1000° F.; introducing an oil-in-water emulsion to drum 22 via chute 26; removing combustible gas by shutting off its supply via conduit 40; controlling the temperature within drum 22 to between about 1600°-1800° F. by adjusting the flow rate of the fluidizing gas, the speed of drum 22, and the rate of introduction of oil-in-water emulsion; and introducing secondary air via air nozzles 30 and tertiary air via conduit 31. The fluidizing gas is preferably fed into drum 22 at a rate lower than that necessary to provide for complete combustion of the oil-in-water emulsion so as to produce a low Btu gas.

Drum 22 is rotated by shaft 44 and drive belt 42 driven by motor 43. Shaft 44 includes a post 45, oil seals 46, inner shell 47, outer shell 48 and bearings 60. Shaft 44 Is connected to a distributor plate 49 of rotatable housing 50. Housing 50 is connected to drum 22 is such a manner as to provide a conduit 51 between housing 50 and circumferentially extending wall 23 so that fluidizing gas from conduit 24 may enter housing 50 via distributor plate 49 and thereafter pass into drum 22 via conduit 51 and circumferentially extending wall 23. Rotatable housing 50 is rotatably disposed between combustor housing 53 and de-$NO_x$ boiler 27 which remain stationary during normal operation. Drum 22 preferably rotates at a speed in the range between about 50 rpm to about 1000 rpm.

Subsequent to starting up gasifier 20, oil-in-water emulsion is continuously fed via feed chute 26 into drum 22. Drum 22 is maintained at a temperature of approximately 1600°-1800° F. which provides a reducing environment and generates a hot low Btu gas, i.e., 100-160 Btu/ft$^3$. The resultant gas exits drum 22 and enters quench zone 28 of de-$NO_x$ boiler 27 where the temperature of the gas is lowered. After the temperature of the gas is lowered to approximately 1100°-1500° F. secondary air is injected into de-$NO_x$ boiler 27 via secondary air nozzles 30. Secondary air reacts with the gas in nitrogen fixing zone 29 in accordance with the below equation:

$$4NH_3+3O_2+N_2 \longrightarrow 6H_2O+3N_2$$

The low Btu gas has a temperature after passing through nitrogen fixing zone 29 of approximately 1200°-1400° F. The nitrogen fixed low Btu gas passes through an inner register 56 mounted on boiler 21. An outer register 57, also mounted on boiler 21, is arranged so that tertiary air or final combustion air from conduit 31 passes through outer register 57 and into boiler 21 to cause complete combustion of the low Btu gas emitted from gasifier 20. Since some ash particles escape from gasifier 20 into boiler 21, the resultant flame is luminous. Optionally, a bed material reclamation unit 59 with conduits 58 and 60 is attached to gasifier 20.

Figure 2:
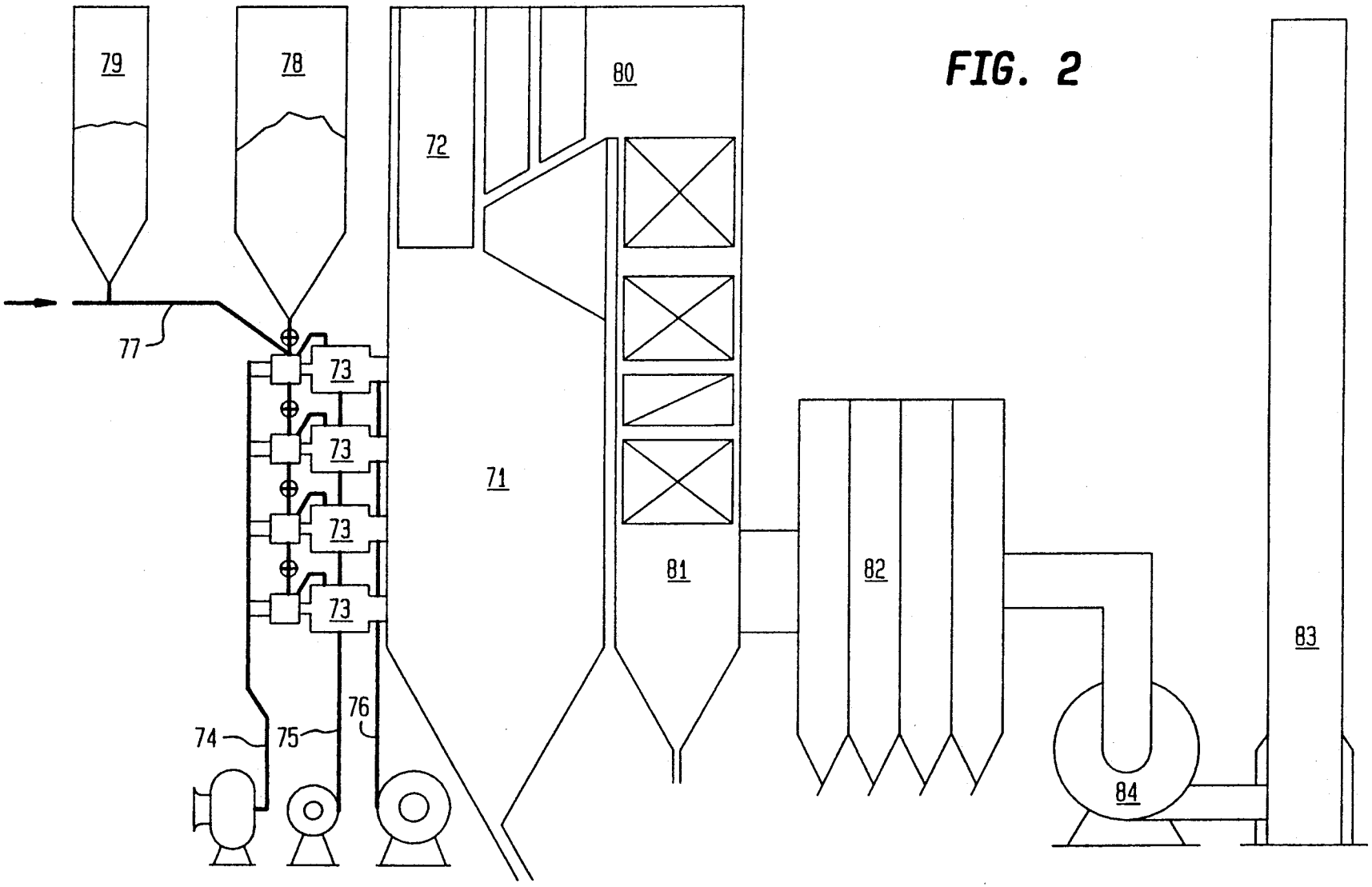
FIG. 2 is a schematic representation of the rotary fluid bed gasifier used in a boiler system.
Figure 3:
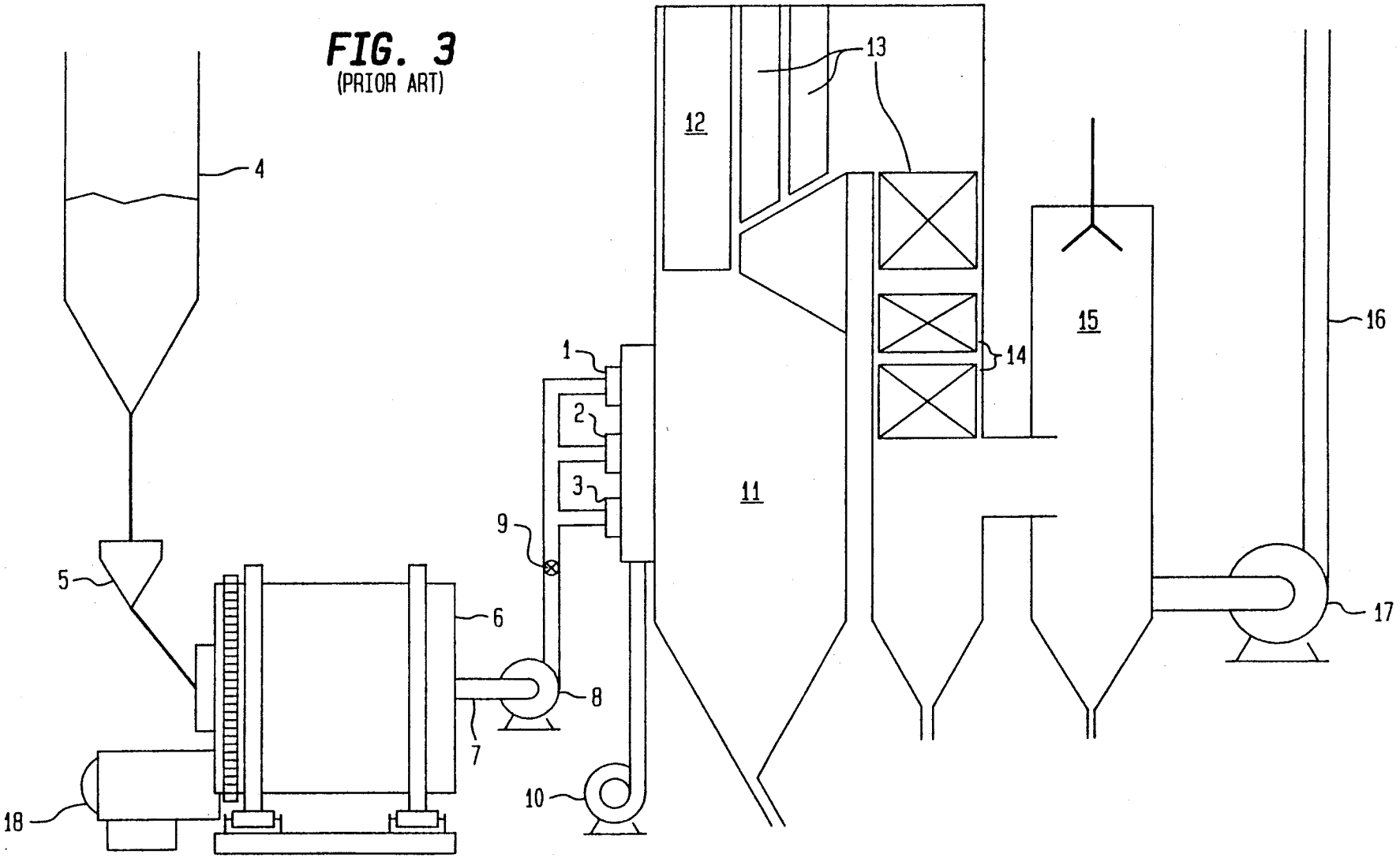
FIG. 3 (PRIOR ART)
FIG. 3 is a schematic representation of the use of a conventional coal burners in a boiler system.

The rotary fluid bed gasifier is typically mounted onto a conventional boiler. FIG. 2 is a boiler system having a boiler 70 with combustion chamber 71 and platens 72. Attached to the sidewall of boiler 70 at the level of combustion chamber 71 are three rotary fluid bed gasifiers 73, although it is contemplated that any number of gasifiers may be used as needed. Each gasifier 73 is connected to means for supplying a fluidizing gas 74 (approximately 44,276 lbs/hr), secondary air 75 (approximately 22,450 lbs/hr) and tertiary air 76 (approximately 49,804 lbs/hr).

During operation gasifiers 73 are heated to a temperature of approximately 1000° F. by providing a fluidizing gas 74 containing a mixture of air and a combustible gas, e.g., propane or natural gas. After attaining the desired start-up temperature oil-in-water emulsion and limestone are introduced to gasifiers 73 via conduit 77. The oil-in-water emulsion and limestone are stored in hoppers 78 and 79, respectively. Gasifiers 73 thereafter emit a low Btu gas flame into combustion chamber 71. The flame has temperature of approximately 2200°-2400° F.

The heat generated from the flame of gasifiers 73 produces steam in heat exchange means disposed within boiler 70. The flue gas exits combustion chamber 71 via platens 72 and superheater 80. Thereafter, the flue gas passes through economizer 81 and baghouse 82, and is directed from baghouse 82 to stack 83 via blower 84. The flue gas which is emitted to the atmosphere via stack 83 typically has $SO_x$ of less than 10% and $NO_x$ of less than 25 ppm.

It is believed that the rotary fluid bed gasifier of the present invention could be installed or retrofited to conventional 50-660 megawatt pulverized coal boilers in place of conventional burners. This gasifier may also be attached to a reverberating furnace for metal melting or heat treatment. This gasifier can be used to successfully gasify and combust oil-in-water emulsions, while reducing their normal $SO_x$ and $NO_x$.

Figure 4:
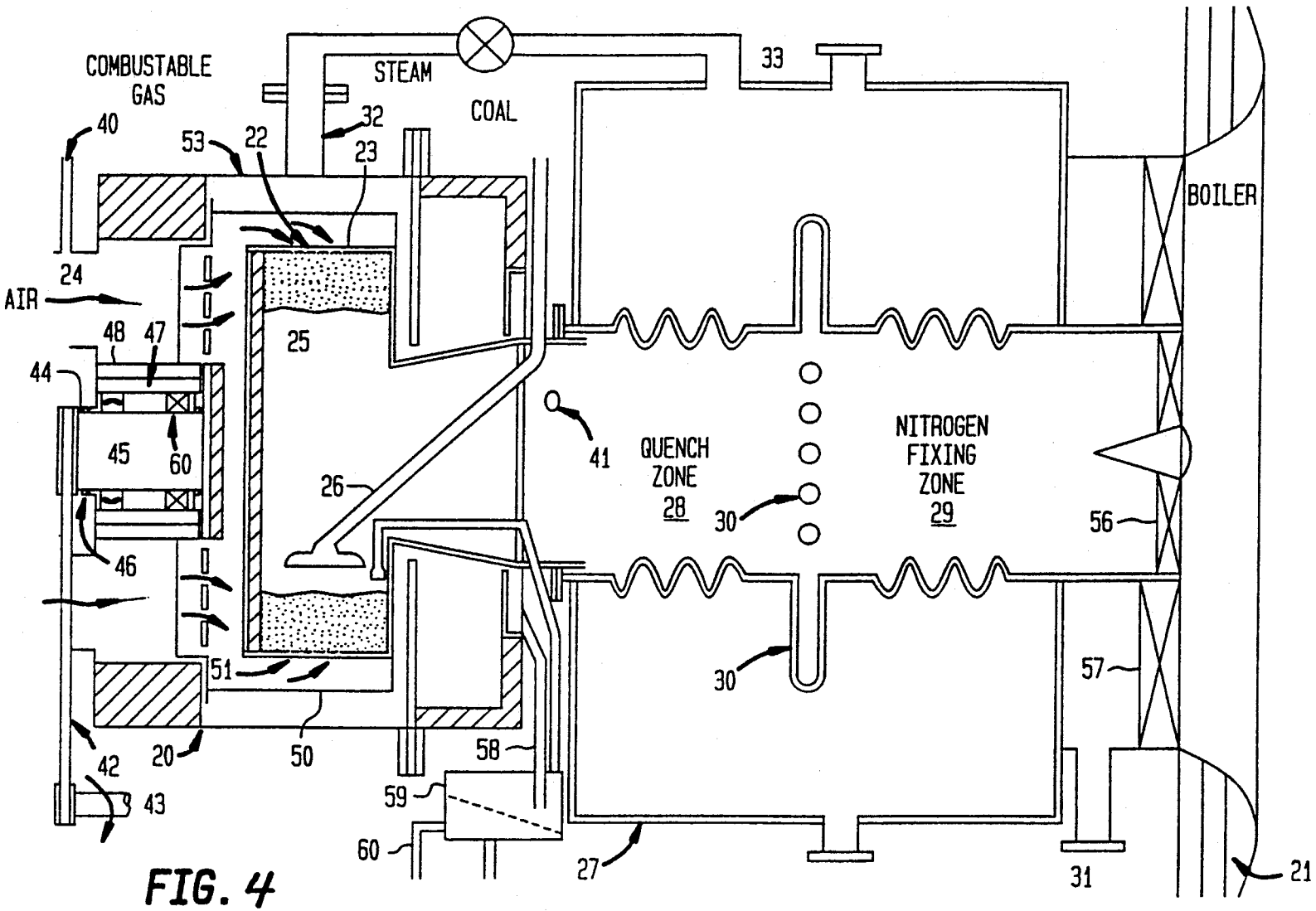
FIG. 4 is a schematic representation of the gasifier wherein steam is supplied to the de-$NO_x$ boiler.

As shown in FIG. 4, gasifier 20 may also include a means 32 for introducing steam into drum 22. The steam is obtained from conduit 33 of de-$NO_x$ boiler 27. The steam together with a fluidizing gas comprising approximately 10-80% stoichiometric air produces a reducing condition in drum 22. Therefore, air and/or steam may be used in the de-$NO_x$ boiler 27 to reduce the temperature of the gas exiting drum 22.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. A method of producing steam from the combustion of a oil-in-water emulsion in a rotary fluid bed gasifier comprising a rotatable drum having a circumferentially extending wall which is permeable to gases, a means for feeding a fluidizing gas through said wall into said drum, a bed of particles which, at least when said gasifier is in use, is supported on an internal face of said wall and is fluidized by said gas, an outlet means for receiving an oil-in-water emulsion from outside said gasifier and delivering said oil-in-water emulsion to said drum, a de-$NO_x$ boiler having a quench zone and a nitrogen fixing zone, a means for introducing secondary air disposed between said quench zone and said nitrogen fixing zone, and a means for introducing tertiary air disposed between said de-$NO_x$ boiler and a main boiler, comprising the steps of:

introducing said fluidizing gas and a combustible gas into said drum wherein said bed particles are fluidized;

igniting said combustible gas within said drum;

heating said bed particles to approximately 1000° F.;

introducing an oil-in-water emulsion to said drum;

removing said combustible gas;

controlling the temperature within said drum to between about 1600°-1800° F. by adjusting the flow rate of said fluidizing gas, the speed of said drum, and the rate of introduction of said oil-in-water emulsion; and introducing said secondary air into said de-$NO_x$ boiler and said tertiary air between said de-$NO_x$ boiler and said main boiler.

2. The method according to claim 1, wherein said drum is rotated at a speed in the range between about 50 rpm to about 1000 rpm.

3. The method according to claim 1, wherein the temperature in the quench zone is approximately 1100°-1500° F.

4. The method according to claim 1, wherein the temperature in the nitrogen fixing zone is approximately 1200°-1400° F.

5. The method according to claim 1, wherein the burning of said oil-in-water emulsion within said drum produces a low Btu gas in an amount between about 100-160 Btu/$ft^3$.

6. The method according to claim 1, wherein said fluidizing gas is fed into said drum at a rate lower than that necessary to provide for complete combustion of said oil-in-water emulsion so as to produce a low Btu gas.

7. The method according to claim 6, wherein said fluidizing gas is 10-80% stoichiometric air.

8. A method of gasifying an oil-in-water emulsion in a rotary fluid bed gasifier comprising a rotatable drum having a circumferentially extending wall which is permeable to gases, a means for feeding a fluidizing gas through said wall into said drum, a bed of particles which, at least when said gasifier is in use, is supported on an internal face of said wall and is fluidized by said gas, and an outlet means for receiving an oil-in-water emulsion from outside said gasifier and delivering said oil-in-water emulsion to said drum, comprising the steps of:

introducing said fluidizing gas and a combustible gas into said drum wherein said bed particles are fluidized;

igniting said combustible gas within said drum;

heating said bed particles to approximately 1000° F.;

introducing an oil-in-water emulsion to said drum;

removing said combustible gas;

introducing steam into said drum; and controlling the temperature within said drum to between about 1600°-1800° F. by adjusting the flow rate of said fluidizing gas and said steam, the speed of said drum, and the rate of introduction of said oil-in-water emulsion.

9. The method according to claim 8, wherein said drum is rotated at a speed in the range between about 50 rpm to about 1000 rpm.

10. The method according to claim 8, wherein the burning of said oil-in-water emulsion within said drum produces a low Btu gas in an amount between about 100-160 Btu/$ft^3$.

11. The method according to claim 8, wherein said fluidizing gas is fed into said drum at a rate lower than that necessary to provide for complete combustion of said oil-in-water emulsion so as to produce a low Btu gas.

12. The method according to claim 11, wherein said fluidizing gas is 10-80% stoichiometric air.

13. The method according to claim 1, wherein said rotary fluid bed gasifier includes a means for introducing steam into said drum.

14. The method according to claim 8 further comprising the step of introducing steam into said drum.

* * * * *